US010214033B2

(12) United States Patent
Hoffman, Jr. et al.

(10) Patent No.: US 10,214,033 B2
(45) Date of Patent: Feb. 26, 2019

(54) TEXTILE PALLET WITH ADJUSTABLE FRAME

(71) Applicant: M&R Printing Equipment, Inc., Roselle, IL (US)

(72) Inventors: Richard C. Hoffman, Jr., Lake Forest, IL (US); Darek Tkacz, Naperville, IL (US); Jan Dolega, Bolingbrook, IL (US)

(73) Assignee: M&R Printing Equipment, Inc., Roselle, IL (US)

( * ) Notice: Subject to any disclaimer, the term of this patent is extended or adjusted under 35 U.S.C. 154(b) by 0 days.

(21) Appl. No.: 15/631,523

(22) Filed: Jun. 23, 2017

(65) Prior Publication Data

US 2018/0370258 A1 Dec. 27, 2018

(51) Int. Cl.
*B41J 11/58* (2006.01)
*B41J 3/407* (2006.01)

(52) U.S. Cl.
CPC ..... *B41J 11/58* (2013.01); *B41J 3/4078* (2013.01)

(58) Field of Classification Search
CPC ..... B41J 3/4078; B41J 11/58
See application file for complete search history.

(56) References Cited

U.S. PATENT DOCUMENTS

2015/0107467 A1* 4/2015 Hoffman, Jr. ..... B41F 15/10 101/126

* cited by examiner

*Primary Examiner* — Lamson Nguyen
(74) *Attorney, Agent, or Firm* — Greensfelder, Hemker & Gale, P.C.

(57) ABSTRACT

A textile holder having adjustable side extensions is provided. The side extensions can be generally U-shaped metal rods or wires having a plurality of spaced notches for adjusting the spacing of the wires from a central pallet portion. Alternatively, other structures, such as plates can be used for the side extensions. The plates can include one or more slots. Screws or posts on the central pallet portion can be used to align the plates at appropriate extension distances and hold the plates in place.

19 Claims, 8 Drawing Sheets

SCALE 3:25

TEXTILE PALLET WITH ADJUSTABLE FRAME

CROSS-REFERENCE TO RELATED APPLICATIONS

None.

FEDERALLY SPONSORED RESEARCH OR DEVELOPMENT

N/A

FIELD OF THE INVENTION

The present invention generally relates to an expandable textile pallet for use in a textile printing operation having one or more adjustable extension elements; and more particularly, to a textile pallet (such as a T-shirt side holder pallet), with first and second adjustable side extensions (such as wire frames or plates) to enable adjustment of the width of the pallet for facilitating centering of larger than typical textiles on the pallet.

DESCRIPTION OF THE PRIOR ART

A number of different pallets are used for textile printing. The pallets are designed to hold the textile (e.g., a garment) flat during a printing operation. The textiles also need to be properly centered on the pallet for printing of images or other graphics.

In typical situations, an operator can slide a textile, such as a T-shirt, over the pallet and center it in one motion because the shirt is close in size to the typical pallet (e.g., standard 16" or 18" wide pallets). However, it is more difficult to center the textile when it is much larger. For example, for shirts that are twice as larger (or even larger) than the pallet, the operator has to put the shirt on the pallet, step back to observe its position, then readjust, and repeat as necessary in order to get the garment properly centered. This can be time consuming and inefficient.

Attempts have been made to create pallets that do not require re-adjustment of the textile to reduce or eliminate folds or creases in the areas that require printing. Additionally, the pallets should prevent the textile from hanging down and dragging or snagging on the printing equipment.

The present invention described herein provides an improved textile pallet that can be used—for example—for holding an extra-large T-shirt. The width of the pallet can be adjusted to facilitate centering of different size textiles.

SUMMARY OF TEE INVENTION

The present invention provides a textile holder, e.g., a t-shirt side holder pallet, having adjustably extending side elements. The textile holder can be easily expanded which enables an operator to quickly center extra-large textiles.

That is, the side elements can be adjusted outward to expand the effective width of the pallet. This facilitates centering of larger than normal textiles (e.g., XXL T-shirts) and reduces set-up time. The side elements can be, for example, metal rods or wires having a plurality of spaced notches along the end portions. The spaced notches can be engaged by extension holders on a central pallet element to provide for specifically desired dimensions. Extendable plates or other similar structures can also be utilized.

In accordance with one aspect of the invention, a textile holder having adjustable side extensions is provided. The textile holder comprises a pallet having a first surface for supporting a textile and an opposing second surface, the pallet having a first side and an opposing second side, a first end and an opposing second end. An adjustable side extension in the form of a first wire and a first wire holder is provided. The first wire holder is connected to the second surface of the pallet. The first wire extends from the first side of the pallet and includes a first end adjustably connected to the first wire holder.

The first wire holder can include a wire engagement element. The wire engagement element in the first wire holder can be a locking pin or other similar locking structures. Additionally, tension can be used to hold the wire in place.

The textile holder can include a second wire holder connected to the second surface of the pallet spaced from the first wire holder. The first wire includes a second end adjustably connected to the second wire holder. Like the first wire holder, the second wire holder can include a wire engagement element, such as a locking pin, etc.

The first wire includes a first notch proximate the first end for engaging the locking pin in the first wire holder. Moreover, the first wire can include a first plurality of spaced notches proximate the first end for engaging the locking pin in the first wire holder and a second plurality of spaced notches proximate the second end for engaging the locking pin in the second wire holder. The spaced notches can be used to position a central part of the wire (that can run parallel to the side of the pallet) a particular distance from the side of the pallet. In this regard, the wire is generally U-shaped having the first end, the central part and the second end.

The textile holder can further comprise a third wire holder connected to the second surface of the pallet and a fourth wire holder connected to the second surface of the pallet spaced from the third wire holder. A second wire can extend from the second side of the pallet having a first end adjustably connected to the third wire holder and a second end adjustably connected to the fourth wire holder.

The textile holder can further comprise a mounting element connected to the second surface of the pallet. The mounting element enables the pallet to connect to a textile printing apparatus.

In accordance with another aspect of the invention, a textile holder with expansion elements is provided. The textile holder comprises a pallet having a first surface for supporting a textile and an opposing second surface. The pallet has a first side and an opposing second side, a first end and an opposing second end. A first side extension is adjustably connected to the pallet to extend outward from the first side for effectively modifying the width of the pallet. A second side extension can be adjustably connected to the pallet to extend outward from the second side for effectively modifying the width of the pallet.

The first side extension can be a first wire having a first end, a central portion and a second end. The textile holder can include a first wire holder connected to the pallet for receiving the first end of the first wire and a second wire holder connected to the pallet for receiving the second end of the first wire. The first end of the first wire can include a plurality of spaced notches and the second end of the first wire includes a corresponding plurality of spaced notches.

The first wire holder can include a wire engagement element and the second wire holder can include a wire engagement element. The wire engagement elements can be locking pins.

The textile holder can include a mounting element connected to the second surface of the pallet to enable the pallet to connect to a textile printing apparatus.

The first side extension can be a first plate. Similarly, the second side extension can by a second plate. The first and second plates can each include a first slot (or more slots as necessary) and can be connected to the central portion of the pallet by a first post positioned in the first slot (a post for each slot).

In accordance with another aspect of the invention, an expandable textile holder for use in a textile printing apparatus is provided. The textile holder is configured for facilitating centering of large textiles. The textile holder comprises a central pallet portion and an adjustable element connected to the central pallet portion.

Further aspects of the present invention are discussed herein and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
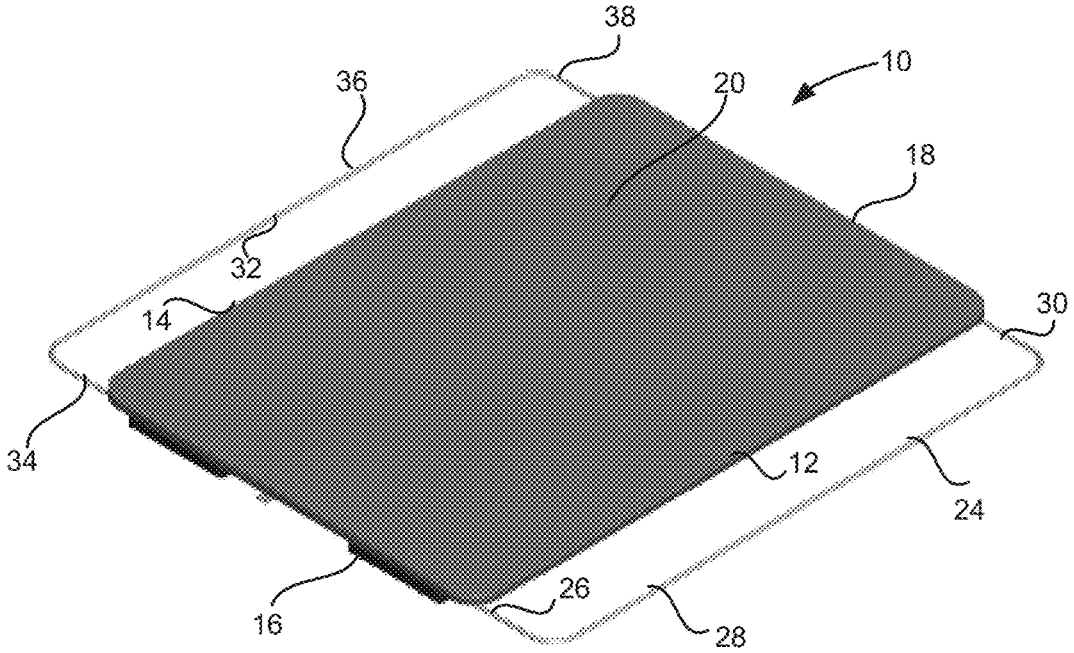
FIG. 1 is a perspective view of a textile pallet with an adjustable wire frame in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

An extendible textile pallet 10 in accordance with the present invention is shown in FIG. 1. The pallet 10 includes a central portion having a first side 12, an opposing second side 14, a first end 16 and an opposing second end 18. The pallet 10 includes a first upper, support surface 20 and a second, lower surface 22 (see e.g., FIG. 2) opposing the first surface 20.

The pallet 10 includes extendable features (i.e., adjustable side extensions) to adjustably change the effective width of the system. The features can include metal wires (or other similar structure or materials) adjustably connected to the pallet by special holders.

In accordance with one aspect of the invention, a first adjustably connected side extension in the form of a first metal rod or wire 24 extends outward from the first side 12 of the pallet 10. The first wire 24 includes a first end 26, a central portion 28 and a second end 30. The pallet 10 can also include a second adjustably connected side extension in the form of a second metal rod or wire 32 that extends outward from the second side 14 of the pallet 10. The second wire 32 includes a first end 34, a central portion 36 and a second end 38. The first and second wires 24, 32 are generally U-shaped (with squared off corners). The first and second ends of the wires 24, 32 are used to connect the wires 24, 32 to the pallet 10. The central portions 28, 36 of each wire 24, 32 run generally parallel to the sides 12, 14 of the pallet 10.

Figure 2:
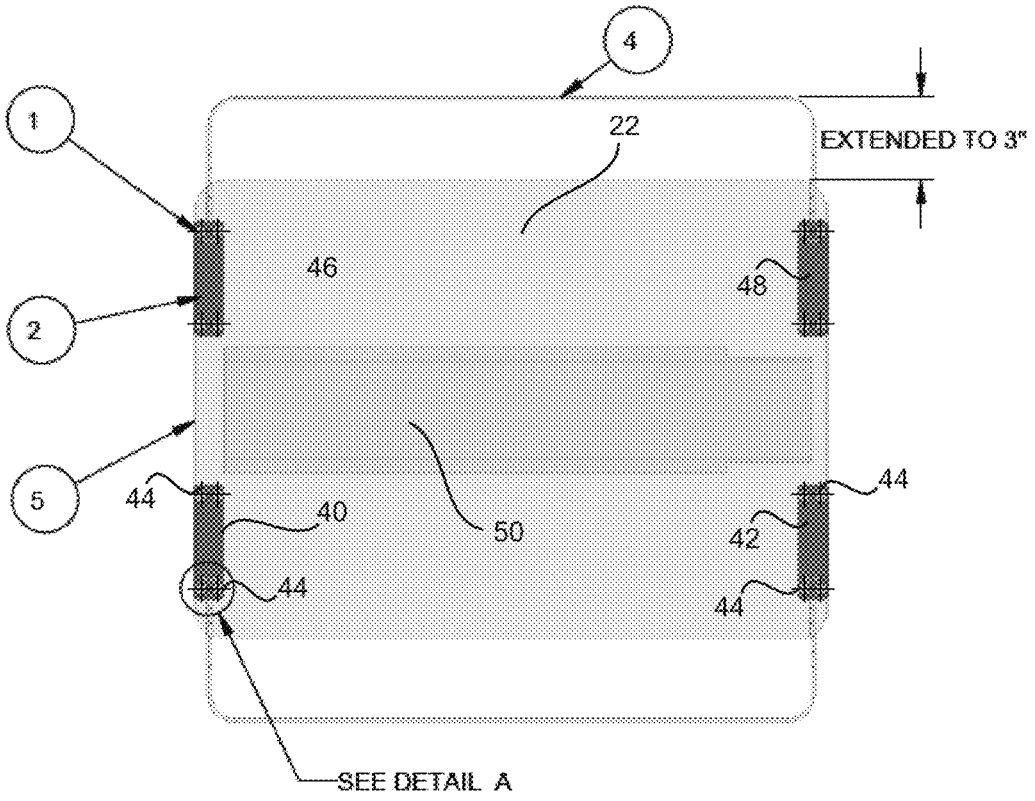
FIG. 2 is a bottom plan view of the textile pallet with an adjustable wire frame of FIG. 1.

As shown in FIG. 2, the pallet 10 includes a first wire holder 40 and a second wire holder 42 connected to the second surface 22 of the pallet 10. The first and second wire holders 40, 42 are secured to the second surface 22 proximate the first and second ends 16, 18 and the first side 12 by a plurality of screws 44 (or other similar fasteners).

The first end 26 of the first wire 24 is adjustably connected to the first wire holder 40 and the second end 30 of the first wire 24 is adjustably connected to the second wire holder 42. Movement of the ends 26, 30 toward or away from the first and second wire holders 40, 42 adjusts the distance of the central portion 28 of the first wire 24 from the first side 12 of the pallet 10. In this manner, the width of the pallet (i.e., including the first wire 24) can be adjusted as needed.

A third wire holder 46 and a fourth wire holder 48 are secured to the second surface 22 proximate the first and second ends 16, 18 and the second side 14 of the pallet 10. The third and fourth wire holders 46, 48 are used to adjustably connect the first and second ends 34, 38 of the second wire 32 in the same manner as the first and second wire holders 40, 42.

Figure 3:
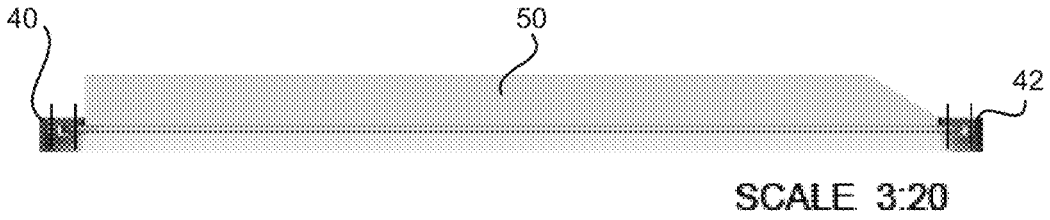
FIG. 3 is side view of an upside down textile pallet with an adjustable wire frame of FIG. 1.
Figure 4:
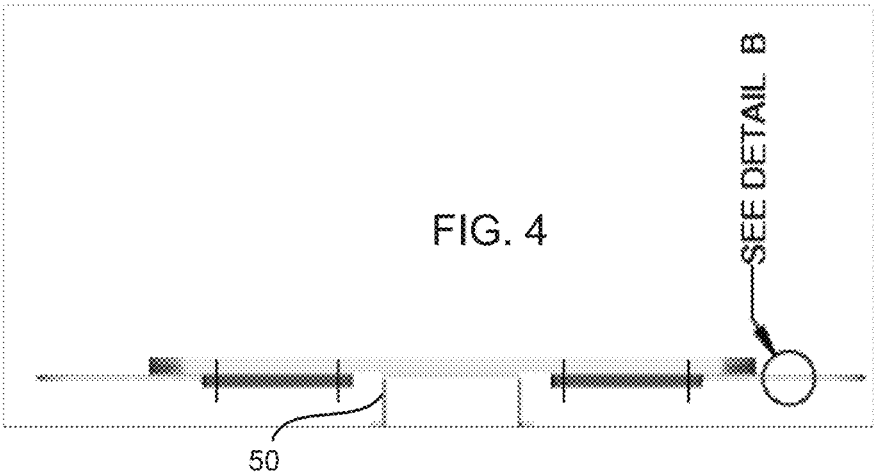
FIG. 4 is an end view of the textile pallet with an adjustable wire frame of FIGURE

As illustrated in FIGS. 2-4, a mounting element or bracket 50 is also secured to the bottom surface 22 of the pallet 10. The mounting bracket 50 is utilized to secure the pallet 10 to a textile printing apparatus.

Figure 5:
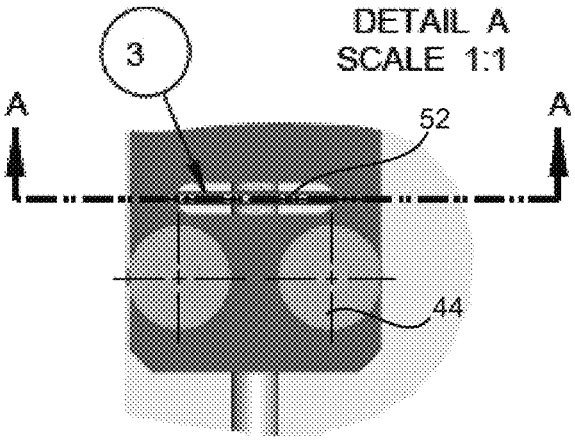
FIG. 5 is an enlarged bottom view of a holder support of the textile pallet with an adjustable wire frame of FIG. 2.

FIG. 5 shows a partial, close up view of a wire holder. Each wire holder is in the form of a block of material (e.g., aluminum) with an opening for receiving an end of the wire. The wire holder also includes a window 52 that shows the end of a wire in the holder.

Figure 6:
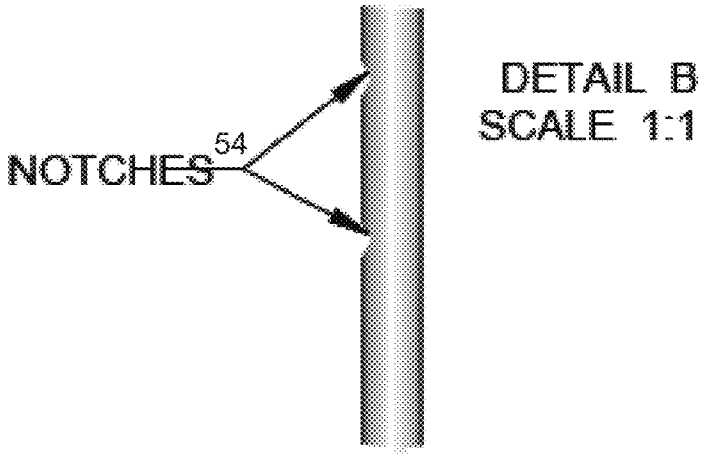
FIG. 6 is an enlarged view of a segment of the wire frame of the textile pallet with an adjustable wire frame of FIG. 4.

As shown in FIG. 6, the ends of the wire are provided with one or more spaced notches 54 formed by inclined surfaces on the face of the wire. The notches 54 interact with structure in the wire holder which engages the wire at the notch and prevents the wire from moving. The structure can be a locking pin 56 (see FIG. 7) to secure the wire at precise positions (i.e., moving the central portion to specific distances from the side of the pallet). The locking pin 56 can be spring loaded or otherwise have some flexibility to move. The inclined surfaces forming the notches 54 can act as caroming surfaces or mechanism to move the pin from the locking position when adjusting the position of the wire.

This design allows the wire to be easily pulled out if any object gets trapped between the wire and the side of the pallet.

Figure 8:
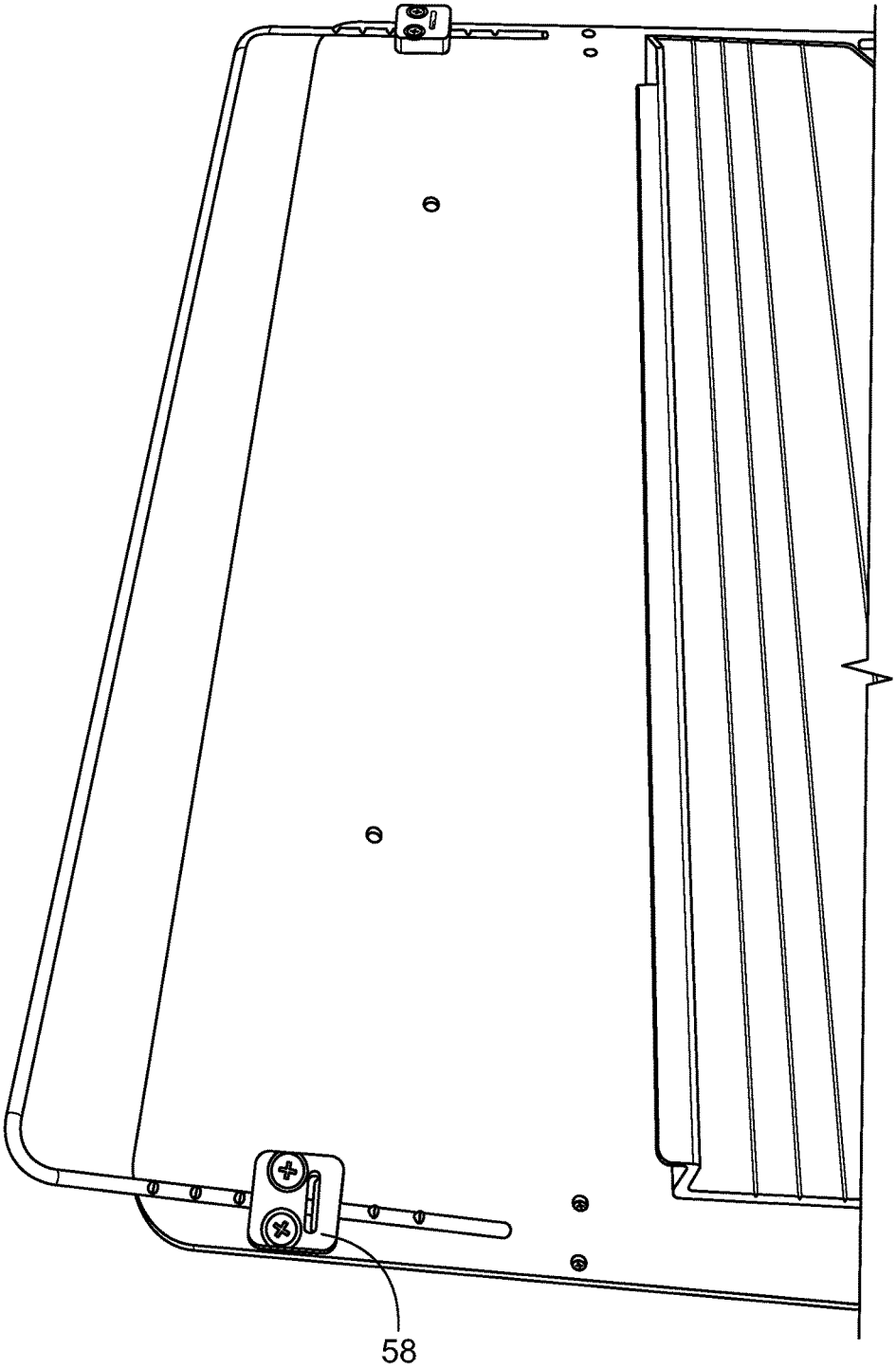
FIG. 8 is a partial perspective bottom view of another textile pallet with an adjustable wire frame of the present invention with a smaller holder support.

As shown in FIG. 2, the wire holders 40, 42, 46 and 48 are secured to the second surface 22 of the pallet 10 by four screws 44 each. A smaller version of a wire holder 58 (needing only two screws 44) is shown in FIG. 8.

The screws (in either version) can be used to adjust tension applied to the wires. Such tension can facilitate holding the wires in place in addition to or in the absence of the notches and/or a locking pin.

Figure 7:
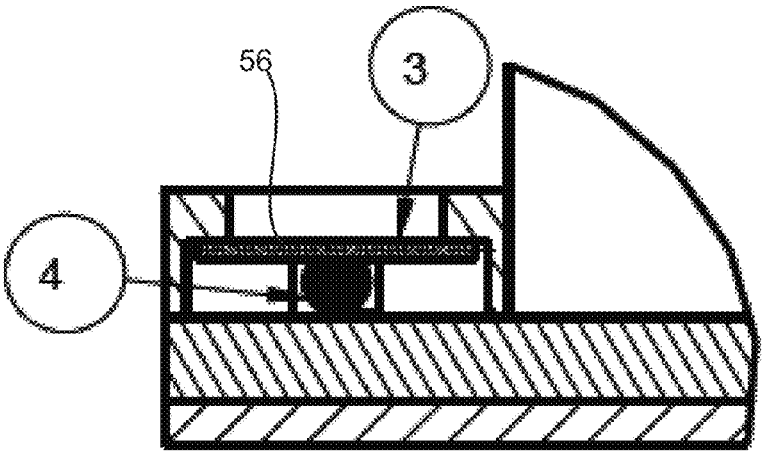
FIG. 7 is a cross-sectional view of the holder support of the textile pallet with an adjustable wire frame of FIG. 5.

In addition to the pin structure shown in FIG. 7, other structures can be used to lock the ends of the wire in place. For example, the wire holder can include a ball plunger or spring loaded ball (or similar structure) that locks in a hole or groove in the wire. Alternatively, a frictional engagement can be used. In another example, the wire can be connected by a threaded mechanism or other friction or mechanical locking mechanism.

In addition to (or in the absence of) the notches, the wires can be provided with indicia or other markings to indicate the length the wire is extended.

Figure 9:
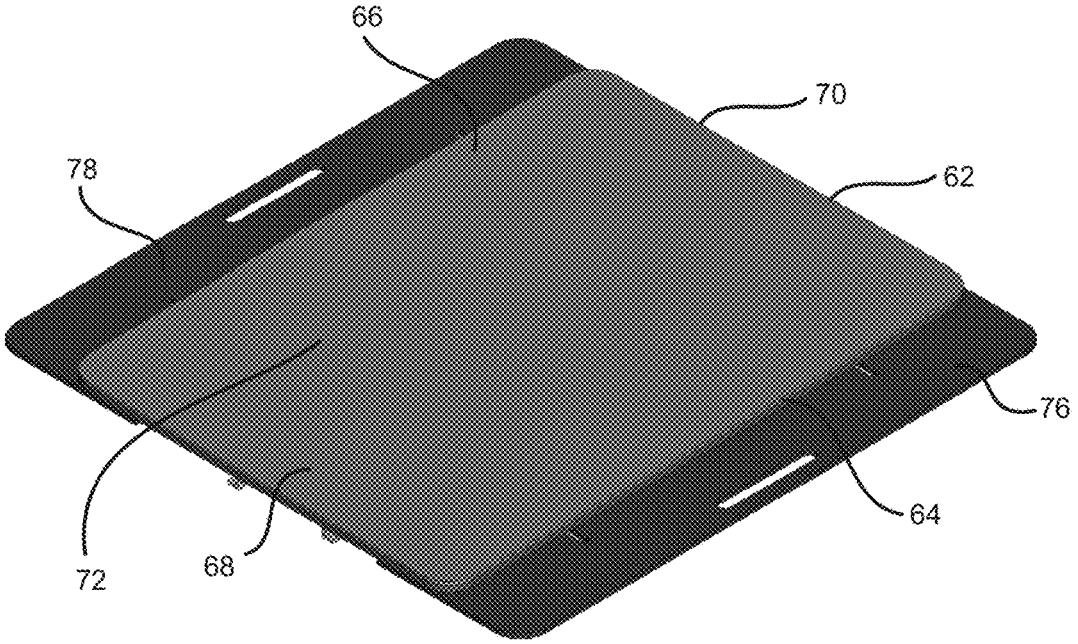
FIG. 9 is a perspective view of a textile pallet with side extensions in accordance with the present invention.

FIGS. 9-12 show another extendible textile pallet 60 of the present invention. As shown in FIG. 9, the pallet 60 includes a central portion 62 having a first side 64, an opposing second side 66, a first end 68 and an opposing second end 70. The pallet 60 includes a first upper, support surface 72 and a second, lower surface 74 (see FIG. 10) opposing the first surface 72.

The pallet 10 includes a first extendible side plate 76 connected to the lower surface 74 of the central portion 62. The first extendible side plate 76 can be adjustably extended from the first side 64 of the central portion 62. The pallet 10 also includes a second extendible side plate 78 connected to the lower surface 74 of the central portion 62. The second extendible side plate 78 can be adjustably extended from the second side 66 of the central portion 62.

Figure 10:
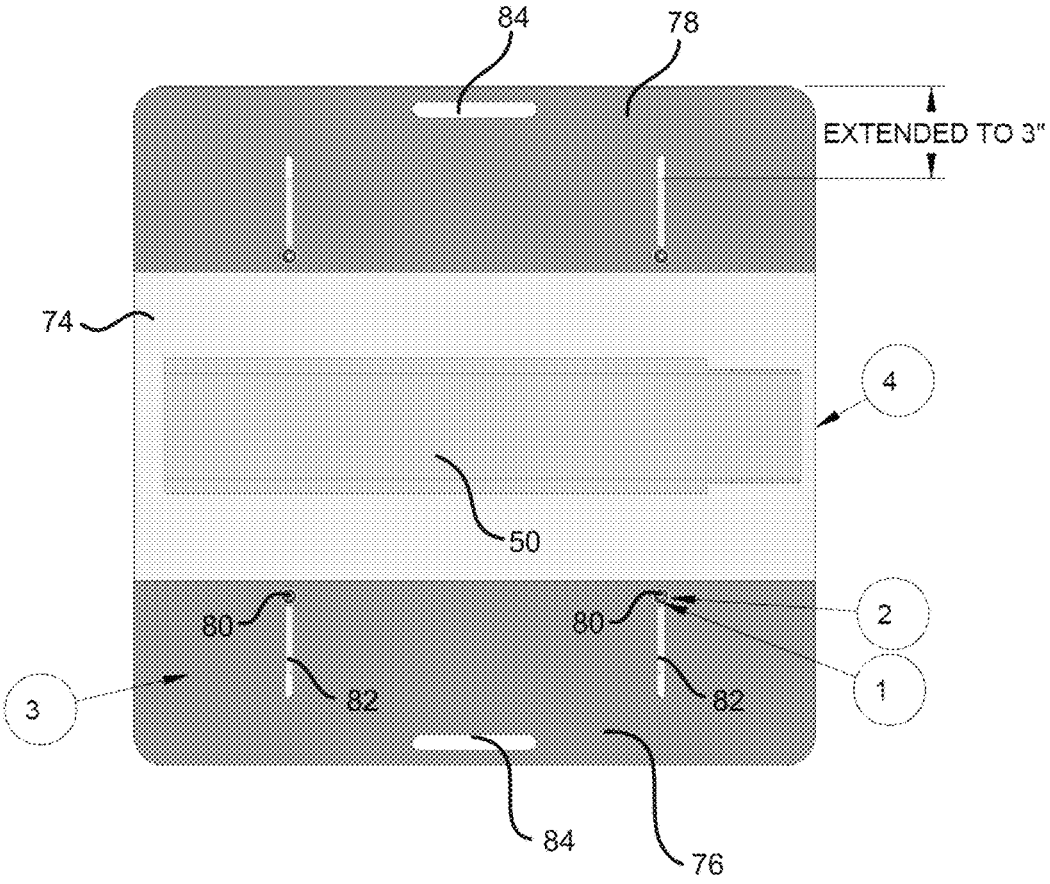
FIG. 10 is a bottom plan view of the textile pallet of FIG. 9.
Figure 11:
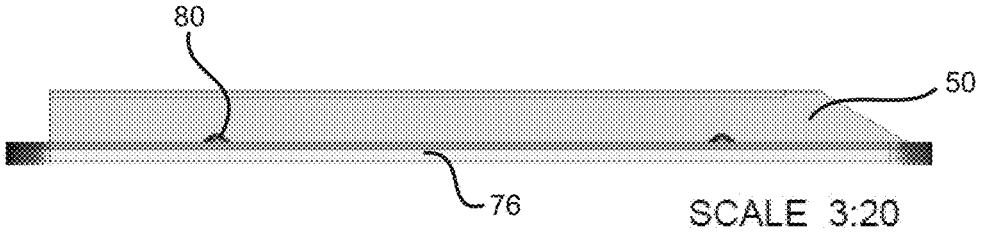
FIG. 11 is a side view of an upside down textile pallet of FIG. 9.
Figure 12:
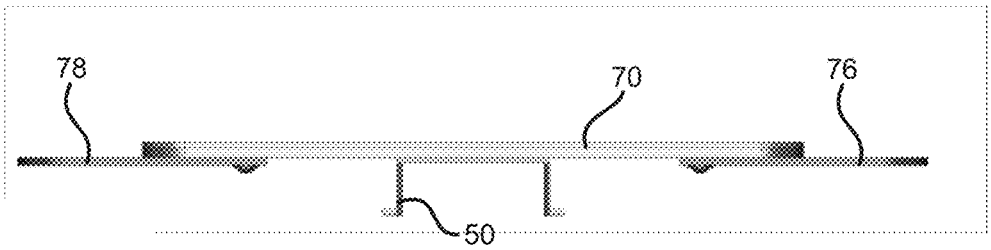
FIG. 12 is an end view of the textile pallet of FIG. 9.

Referring to FIG. 10, the first extendible side plate 76 is connected to the lower surface 74 of the central portion by a first and second screws or posts 80. Each post 80 is positioned in a slot 82 in the first plate 76. The second extendible plate 78 is similarly connected to the lower surface 74 by screws or posts 80 positioned in slots 82. While two posts/slots combinations are shown with respect to each plate, fewer or more can be provided as desired or needed (this may depend on the size of the pallet and plates or other related factors such as weight of components, materials etc.).

To adjust how far a plate extends outward, the plate is slid back or forth along the slots 82, until it is in the desired position. The screws or posts 80 are then tightened to lock the plate in that position (or alternatively, other structure can be added to lock the plate in place once properly positioned). Loosening the screws or posts 80 (or other structure) allows an operator to slide the plate to a new position. Handle openings 84 can be provided to facilitate movement of the plate. Similarly, other handles or handle-like structure can be attached to or otherwise incorporated in the plate.

Additionally, the plates can include indicia, graphics or structure (e.g., a raised line, or groove) to provide specific points to align the plate with respect to the central pallet portion or the screws/posts with in the groove for specific size settings. This will enable an operator to easily set the plate at attain certain desired dimensions for the textile holder In operation, for printing large textiles, the extension element (or both elements if there are two in the system) can be extended to provide a wider structure. This enables an operator to more quickly center the textile on the pallet and avoid downtime needed to make multiple readjustments. The extension element(s) can be returned to a contracted setting or removed completely for standard sized textiles.

Other embodiments within the scope of the present invention can be utilized. For example, the central pallet board can include elements that fold to an extended position, or telescope outward from the central portion. The central portion can be formed in multiple pieces and can be designed to expand in manner similar to a dining room table (with or without the leafs filling any central voids).

A large number of materials can be used to form the pallets and extensions. These include metal, plastic, graphite, glass, fiberboard or particle board, etc.

Many modifications and variations of the present invention are possible in light of the above teachings. It is, therefore, to be understood within the scope of the appended claims the invention may be protected otherwise than as specifically described.

We claim:

1. A textile holder comprising:

a pallet having a first surface for supporting a textile and an opposing second surface, the pallet having a first side and an opposing second side, a first end and an opposing second end;

a first wire holder connected to the second surface of the pallet;

a first wire extending from the first side of the pallet having a first end adjustably connected to the first wire holder.

2. The textile holder of claim 1 wherein the first wire holder includes a wire engagement element.

3. The textile holder of claim 2 wherein the wire engagement element in the first wire holder is a locking pin.

4. The textile holder of claim 3 further comprising a second wire holder connected to the second surface of the pallet spaced from the first wire holder and wherein the first wire includes a second end adjustably connected to the second wire holder.

5. The textile holder of claim 4 wherein the second wire holder includes a wire engagement element.

6. The textile holder of claim 5 wherein the wire engagement element in the second wire holder is a locking pin.

7. The textile holder of claim 6 wherein the first wire includes a first plurality of spaced notches proximate the first end for engaging the locking pin in the first wire holder and a second plurality of spaced notches proximate the second end for engaging the locking pin in the second wire holder.

8. The textile holder of claim 7 further comprising:

a third wire holder connected to the second surface of the pallet and a fourth wire holder connected to the second surface of the pallet spaced from the third wire holder;

a second wire extending from the second side of the pallet having a first end adjustably connected to the third wire holder and a second end adjustably connected to the fourth wire holder.

9. The textile holder of claim 3 wherein the first wire includes a first notch proximate the first end for engaging the locking pin in the first wire holder.

10. The textile holder of claim 1 further comprising a mounting element connected to the second surface of the pallet to enable the pallet to connect to a textile printing apparatus.

11. A textile holder comprising:

a pallet having a central portion having a first surface for supporting a textile and an opposing second surface, the central portion having a first side and an opposing second side, a first end and an opposing second end; and, a first side extension element adjustably connected to the central portion to extend outward from the first side of the central portion for adjustably modifying the width of the pallet.

12. The textile holder of claim 11 further comprising:

a second side extension element adjustably connected to the central portion of the pallet to extend outward from the second side of the central portion for adjustably modifying the width of the pallet.

13. The textile holder of claim 11 wherein the first side extension element is a first wire having a first end, a central portion and a second end.

14. The textile holder of claim 13 further comprising a first wire holder connected to the central portion of the pallet for receiving the first end of the first wire and a second wire holder connected to the central portion of the pallet for receiving the second end of the first wire.

15. The textile holder of claim 14 wherein the first end of the first wire includes a plurality of spaced notches and the second end of the first wire includes a corresponding plurality of spaced notches.

16. The textile holder of claim 15 wherein the first wire holder includes a wire engagement element and the second wire holder include a wire engagement element.

17. The textile holder of claim 16 wherein the wire engagement element of the first wire holder is a locking pin and the wire engagement element of the second wire holder is a locking pin.

18. The textile holder of claim 11 wherein the first side extension is a first plate.

19. The textile holder of claim 18 wherein the first plate includes a first slot and the first plate is connected to the central portion of the pallet by a first post positioned in the first slot.

* * * * *